United States Patent [19]

Trotta

[11] Patent Number: 4,963,047

[45] Date of Patent: Oct. 16, 1990

[54] DISPENSING BRUSH

[75] Inventor: Robert A. Trotta, Pembroke, Mass.

[73] Assignee: The Gillette Company, Boston, Mass.

[21] Appl. No.: 504,934

[22] Filed: Apr. 5, 1990

[51] Int. Cl.[5] ..... A46B 11/04

[52] U.S. Cl. ..... 401/183; 401/281; 222/212; 222/192; 222/469

[58] Field of Search ..... 401/183, 275, 137, 19, 401/186, 281, 6, 184, 185, 280; 132/115, 116; 137/614.21; 251/352; 222/533, 536, 191, 192, 210, 212, 215, 469, 106

[56] References Cited

U.S. PATENT DOCUMENTS

| | | | |
|---|---|---|---|
| 611,788 | 10/1898 | Lincoln | 401/281 |
| 845,387 | 2/1907 | Wolfgram | 401/281 |
| 1,817,650 | 3/1958 | Morrill | 401/280 X |
| 2,336,717 | 12/1943 | Crimmins | 401/281 |
| 2,827,650 | 3/1958 | Morrill et al. | 401/186 |
| 2,845,646 | 8/1958 | Robinson | 401/281 |
| 2,927,335 | 3/1960 | Hammond | 401/184 |
| 3,386,793 | 6/1968 | Stanton | 401/183 X |
| 3,446,216 | 4/1967 | Sala | 132/116 |
| 4,055,195 | 10/1977 | Moses | 132/115 |
| 4,143,667 | 3/1979 | Peilet | 132/116 |
| 4,143,982 | 3/1979 | Cox | 401/280 |
| 4,277,193 | 7/1981 | Knaus | 401/183 |
| 4,553,871 | 11/1985 | Niles | 401/183 |
| 4,580,588 | 4/1986 | Swope, Jr. | 401/183 |
| 4,850,729 | 7/1989 | Kramer | 401/183 |

*Primary Examiner*—Richard J. Johnson

*Attorney, Agent, or Firm*—Owen J. Meegan; Aubrey C. Brine; Scott R. Foster

[57] ABSTRACT

A two piece brush for dispensing and applying a material in gel form comprises a brush element having a plurality of bristles and an elongated handle pivotably secured to the brush element for movement from a position adjacent the brush element to a position substantially at right angles to the brush element. An opening is provided extending through the brush element to the bristles which aligns with an opening in the elongated handle entering into a gel retainer in the handle, when the handle is positioned at right angles to the brush element. A flange disposed on the brush element is effective to seal off the opening in the elongated handle with the elongated handle positioned adjacent the brush element.

14 Claims, 2 Drawing Sheets

DISPENSING BRUSH

BACKGROUND OF THE INVENTION

The present invention relates to dispensing brushes in general, and more particularly to a two piece brush for the dispensing and application of material in gel form, which is particularly useful in a wet shaving process.

Various dispensing brushes for grooming and other purposes have been suggested in the prior art, the brushes generally containing a fluid or powder dispersed throughout the brush by manipulation of a valve or other means. Representative of these brushes may be found in U.S. Pat. No. 2,336,717 issued to Crimmins directed to a hair and scalp treating device, U.S. Pat. No. 3,446,216 issued to G. J. Sala which discloses a hair grooming comb, U.S. Pat. No. 4,055,195 issued to L. L. Moses and directed towards a hair comb which includes a fluid reservoir, and U.S. Pat. No. 4,143,982 issued to R. H. Cox and directed to a dispensing brush for discrete materials such as powder.

In each of the above devices, a valving arrangement is provided for dispensing the material to the brush bristles while the device is in use, and for preventing the material from entry into the brush bristles when the brush is not being employed. In most devices of this type, a plurality of elements are required to provide the valve arrangement, which adds additional bulk to the brush as well as increase in the cost of manufacturing the brush. Thus, these devices often become unwieldy in size as well as expensive to purchase. Recently, the introduction of a gel material for shaving has provided an opportunity for employing a dispensing brush for application purposes, as the material is readily formed into a shaving foam when brushed onto the skin of the user. While such devices have been employed wherein a more or less standard shaving brush is provided with refills of gel material, a need has arisen for a inexpensive, easily manufactured device which may be employed for a number of shaves and discarded after the gel material is depleted.

It is therefore an object of the present invention to provide a brush for dispensing and applying a material in gel form which substantially comprises two pieces, which are simple to manufacture and easily assembled.

Another object of the present invention is to provide a two piece brush for dispensing and applying a material in gel form which is compact when not in use for ease of storage, transport and packaging.

A further object of the present invention is to provide a two piece brush for dispensing and applying a material in gel form wherein the gel is dispensable with the brush oriented for use, and gel is automatically shut off from the dispensing mode when the brush is in the non-use condition.

SUMMARY OF THE INVENTION

The aforementioned objects and other objectives which will become apparent as the description proceeds are accomplished by providing a two piece brush for dispensing and applying a material in gel form comprising a brush element having a plurality of bristles provided on its front surface. An opening is formed in the front surface of the brush element extending therethrough to a rear surface and an elongated handle is pivotably secured to the brush element for movement from a position substantially at right angles to the brush element front surface to a position adjacent the brush element rear surface. The handle further comprises means for retaining the material therein having wall structure forming an opening into the retaining means and the opening being positioned for alignment with the opening in the front surface of the brush element when the handle is positioned substantially at right angles to the brush element. Means are disposed on the brush element for sealing engagement with the opening in the handle wall structure when the handle is positioned adjacent the brush element rear surface, in a storage position.

The means for retaining the material generally comprises a molded pouch having flexible walls whereby the material may be squeezed from the pouch by applying pressure to the wall surfaces.

The means for sealing engagement of the opening in the handle wall structure may comprise a flange extending outwardly from the rear wall of the brush member, the flange having an arcuate surface facing the handle wall structure and the handle wall structure comprising an arcuate surface through which the handle wall structure opening is formed The arcuate wall surface on the handle wall structure is disposed in mating engagement with the flange arcuate wall structure with the handle positioned adjacent the brush element rear surface for storage, thereby closing off the means for retaining the material from the opening formed in the front surface of the brush element.

In a more detailed sense, the flange may terminate in a detent portion disposed at its free end which extends downwardly from the brush element rear surface and the handle wall structure may be provided with a lip portion which extends substantially parallel to the longitudinal axis of the handle for locking engagement with the detent portion when the handle is positioned substantially at right angles to the brush element front surface, during usage.

BRIEF DESCRIPTION OF THE DRAWING

The foregoing and other features of the invention will be more particularly described in connection with the preferred embodiment, and with reference to the accompanying drawing, wherein.

DESCRIPTION OF THE PREFERRED EMBODIMENT

Figure 1:
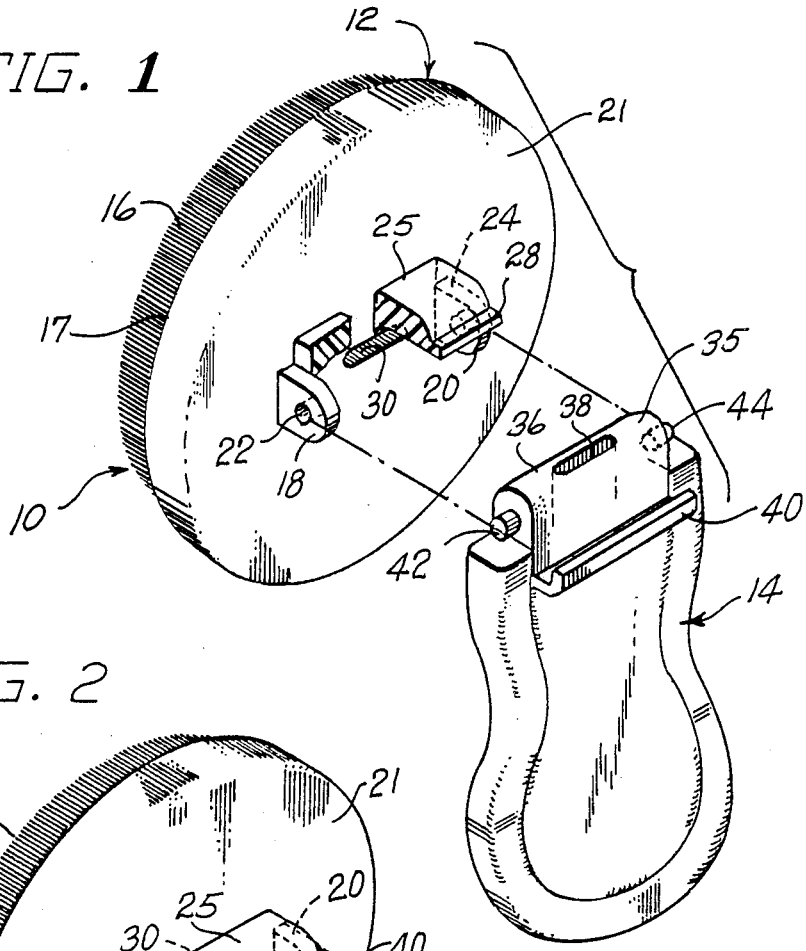
FIG. 1 is an exploded bottom perspective view partially broken away showing details of a two piece brush for applying material in gel form, constructed in accordance with the teachings of the present invention.
Figure 2:
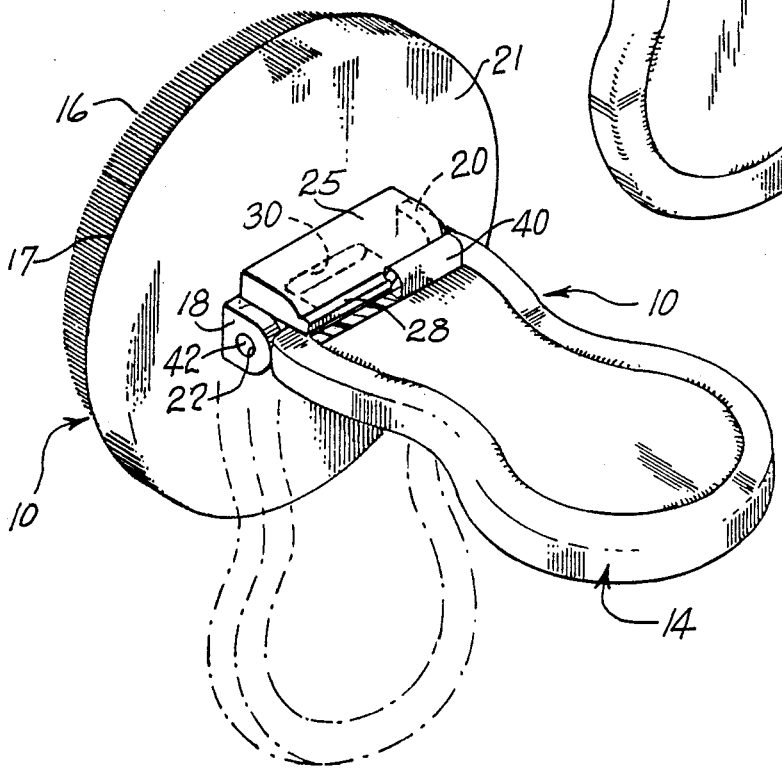
FIG. 2 is a bottom perspective view similar to FIG. 1 showing the elements of FIG. 1 in their assembled form.
Figure 3:
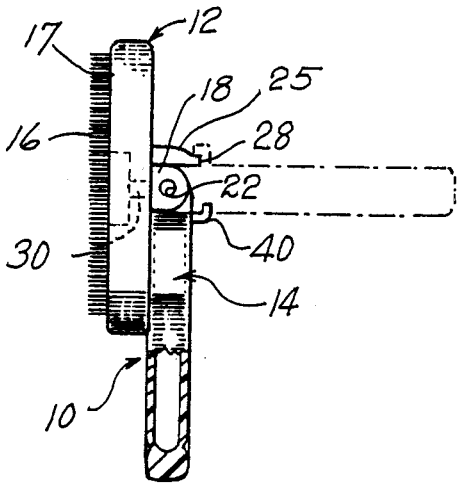
FIG. 3 is a side elevational view partially in section showing details of the structure of FIGS. 1 and 2.
Figure 4:
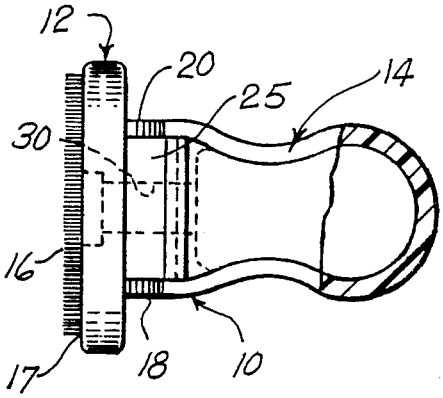
FIG. 4 is a front elevational view partially in section showing further details of the structure of FIGS. 1 through 3.
Figure 5:
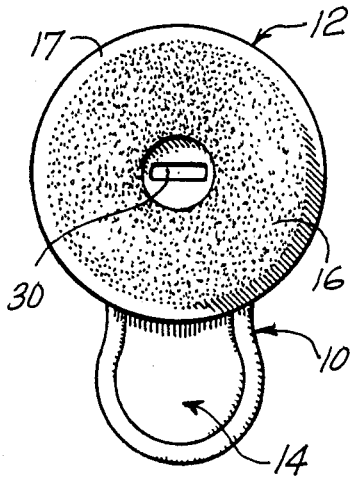
FIG. 5 is a top plan view showing details of the structure of FIGS. 1 through 4.

Turning now to the drawing and in particular to FIGS. 1 and 2, there is shown a two piece brush 10 for dispensing and applying a material in gel form, the brush comprising a brush element 12 and a handle 14. The brush element 12 is formed of a molded polypropylene, polyethylene, or nylon material, polypropylene being preferred, and a plurality of bristles 16 are formed on the top surface 17 of the brush element 12 during the molding process, in a manner which is well known in the art.

Figure 6:
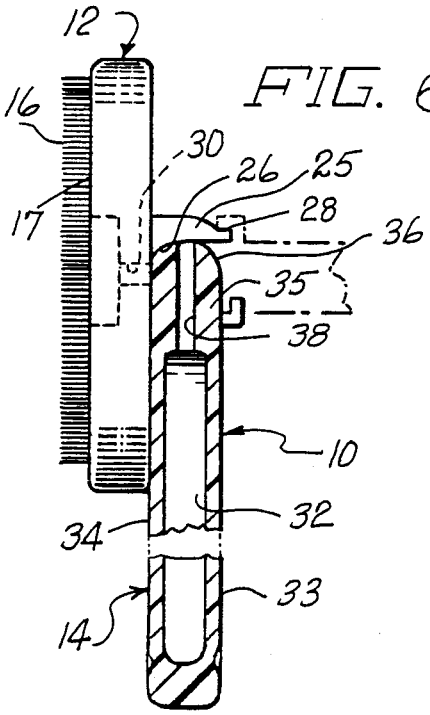
FIG. 6 is a side elevational view, partially in section and similar to FIG. 3 showing details of another element of the structure of FIGS. 1 through 5.

Referring still to FIGS. 1 and 2 taken with FIGS. 3 through 6, a pair of spaced lugs 18 and 20 are formed on the bottom surface 21 of the brush element 12 extending outwardly from the bottom surface, each lug having a cylindrical opening 22 and 24, respectively formed therein in facing relation and in alignment, one with the other. The bottom surface 21 is further provided with an outwardly extending flange 25 formed during the molding process, the flange 25 being disposed in substantial alignment with an inner edge of the lugs 18 and 20, and extending along the area between the lugs. The flange 25 has an arcuate ate surface 26 facing inwardly towards the lugs 18 and 20 and terminating in a detent portion 28, as best shown in FIGS. 1, 2 and 6.

The brush element 12 is further shown to be provided with a slotted opening 30 formed in the brush element 12 extending substantially from the top surface 17 to the bottom surface 21.

Referring particularly to FIG. 6 of the drawing, it will be noted that the handle 14 comprises means for retaining the material therein having wall structure forming a flexible pouch 32 which may be blow molded from a polyethylene or other similar material wherein walls 33 and 34 are squeezable by the user to force material from the pouch. The upper portion of the pouch 32 terminates in a substantially thick semi-rigid upper wall 35 having an arcuate surface 36 formed thereon, and a slotted opening 38 extends through the wall from the arcuate surface 36 to the interior of the pouch. Adjacent the upper portion of the wall 33 a lip portion 40 extends rearwardly and outwardly over substantially the width of the upper wall 35 of the structure. The upper wall 35 is further provided with a pair of cylindrical pins 42 and 44 which extend in opposed relation at either side of the handle 14 and are dimensioned for to be received in the openings 22 and 24 of the brush element 12.

Referring now to FIGS. 1 and 2, to facilitate assembly of the handle 14 to the brush element 12, the lugs 18 and 20 are constructed of a thickness and length such that they may be bent outwardly, away from one another, to the extent that the cylindrical pins 42 and 44 are forced between the inner surface of each of the lugs, and the cylindrical pins are received in the openings 22 and 24, respectively. The two piece brush 10 is now assembled such that the handle 14 is movable from a position shown in solid line in FIG. 2, to the position shown in phantom in FIG. 2. The pouch 32 has been previously filled with a gel material of the type employed in wet shaving, and with the handle 14 in the position shown in phantom, the opening 38 lies in sealing engagement with the arcuate surface 26 of the flange 25.

The brush 10 may be packaged in a bubble pack or other weli known packaging arrangement with the handle 14 in the position adjacent the bottom surface 21 of the brush element 12 for shipping and display purposes.

When it is desired to use the brush 10, the handle 14 is pivoted to the position shown in FIG. 2 wherein the opening 38 is in alignment with the opening 30 and the user, by applying pressure to the pouch 32, will force the gel material to the top surface 17 of the brush element 12. It will be noted that when the handle 14 is moved to the position shown in FIGS. 2 and 4, the lip portion 40 is forced over the detent portion 28 and is locked into position to facilitate the user applying a brushing motion to the skin in the normal fashion, as would be applied by any similar brush and handle arrangement.

After the gel has been applied and brushed into a lather by the two piece brush 10, the handle 14 is folded to the position adjacent the bottom surface 21 at which point the opening 38 is again closed by contact with the arcuate surface 26, and the brush may be stored for future use.

From the foregoing, it is evident that the two piece brush 10 is of simple construction and lends itself to a low cost manufacturing procedure allowing the brush to be disposed of when the pouch 32 has been emptied. In addition, the two piece brush 10 provides ease of operation employing one hand of the user to rotate the handle 14 from the dispensing position to the closed position, if desired.

While it is obvious that changes and modification may be made within the spirit and scope of the present application, it is my intention, however, only to be limited by the scope of the appended claims.

As my invention, I claim:

1. A two piece brush for dispensing and applying a material in gel form comprising:

a brush element having a plurality of bristles provided on the top surface thereof;

an opening formed in said top surface of said brush element extending therethrough to a bottom surface thereof;

an elongated handle pivotably secured to said brush element for movement from a position substantially at right angles to said brush element top surface to a position adjacent said brush element bottom surface, said handle comprising:

means for retaining the material therein having wall structure forming an opening into said retaining means, said opening in said handle wall structure being positioned for alignment with said opening in said top surface of said brush element with said handle positioned substantially at right angles to said brush element top surface; and means disposed on said brush element for sealing engagement with said opening in said handle wall structure with said handle positioned adjacent said brush element bottom surface.

2. A two piece brush as set forth in claim 1 wherein said means for retaining the material comprises a molded pouch having flexible walls whereby the material is squeezed from the pouch by applying pressure thereto.

3. A two piece brush as set forth in claim 1 wherein said brush element comprises a pair of spaced lugs extending outwardly from said brush element bottom surface, each of said lugs having a cylindrical opening formed therein in facing relation and in alignment one with the other, and said handle wall structure comprises a pair of outwardly extending cylindrical pins in alignment one with the other, each said pin being received in a respective lug cylindrical opening to provide for pivotal movement of said handle on said brush element.

4. A two piece brush as set forth in claim 1 wherein said means on said brush element for sealing engagement with said opening in said handle wall structure comprises a flange extending outwardly from said bottom surface of said brush element, said flange having an arcuate surface facing said handle wall structure and wherein said handle wall structure comprises an arcuate surface through which said handle wall structure opening is formed, said arcuate wall surface on said handle arcuate wall structure being disposed in mating engagement with said flange arcuate wall structure with said handle positioned adjacent said brush element bottom surface.

5. A two piece brush as set forth in claim 4 wherein said flange terminate in a detent portion disposed at the free end thereof and extending downwardly from said brush element bottom surface, said handle wall structure further comprising a lip portion extending substantially parallel to the longitudinal axis of said handle for locking engagement with said detent portion with said handle positioned substantially at right angles to said brush element top surface.

6. A two piece brush as set forth in claim 1 wherein said brush element comprises a unitary molded element having said bristles molded thereon.

7. A two piece brush as set forth in claim 6 wherein said brush element is molded from a material taken from the group consisting of polypropylene, polyethylene, or nylon material.

8. A two piece brush as set forth in claim 1 wherein said brush element is in the form of a circular disc.

9. A two piece brush as set forth in claim 2 wherein said brush element comprises a pair of spaced lugs extending outwardly from said brush element bottom surface, each of said lugs having a cylindrical opening formed therein in facing relation and in alignment one with the other, and said handle wall structure comprises a pair of outwardly extending cylindrical pins in alignment, one with the other, each said pin being received in a respective lug cylindrical opening to provide for pivotal movement of said handle on said brush element.

10. A two piece brush as set forth in claim 9 wherein said means on said brush element for sealing engagement with said opening in said handle wall structure comprises a flange extending outwardly from said bottom wall of said brush element, said flange having an arcuate surface facing said handle wall structure and where said handle wall structure comprises an arcuate surface through which said handle wall structure opening is formed, said arcuate wall surface on said handle wall structure being disposed in mating engagement with said flange arcuate wall structure with said handle positioned adjacent said brush element bottom surface.

11. A two piece brush as set forth in claim 10 wherein said flange terminates in a detent portion disposed at the free end thereof and extending downwardly from said brush element bottom surface, said handle wall structure further comprising a lip portion extending substantially parallel to the longitudinal axis of said handle for locking engagement with said detent portion with said handle positioned substantially at right angles to said brush element top surface.

12. A two piece brush as set forth in claim 11 wherein said brush element comprises a unitary molded element having said bristles molded thereon.

13. A two piece brush as set forth in claim 12 wherein said brush element is molded from a polypropylene material.

14. A two piece brush as set forth in claim 13 wherein said brush element is in the form of a circular disc.

* * * * *